United States Patent [19]

Wagner

[11] 4,390,217

[45] Jun. 28, 1983

[54] CONTAINER FOR ARTICLES OF DAILY USE, HAVING TWO ENCLOSABLE CHAMBERS

[76] Inventor: Hans-Ruedi Wagner, 25 Woodale La., Santa Barbara, Calif. 93103

[21] Appl. No.: 216,950

[22] Filed: Dec. 16, 1980

Related U.S. Application Data

[63] Continuation-in-part of Ser. No. 140,774, filed as PCT CH79/00011, Jan. 26, 1979, published as WO 79/00558, Aug. 23, 1979, § 102(e) dated Sep. 26, 1979, abandoned.

[30] Foreign Application Priority Data

Jan. 27, 1978 [CH] Switzerland ..... 936/78

[51] Int. Cl.[3] ..... A47B 46/00; B65D 6/06; B65D 43/20

[52] U.S. Cl. ..... 312/205; 206/566; 217/7; 220/4 B; 220/8; 220/22; 220/345; 220/DIG. 25

[58] Field of Search ..... 220/22, 8, 69, DIG. 25, 220/4 E, 4 B, 345, 20; 206/538, 533, 561, 558, 566; 217/7; 46/24, 25; 312/205, 183

[56] References Cited

U.S. PATENT DOCUMENTS

| | | | |
|---|---|---|---|
| 1,246,072 | 11/1917 | Eisenhauer | 217/7 |
| 1,837,824 | 12/1931 | Marcus | 217/7 X |
| 3,258,017 | 6/1966 | Albert | 206/561 X |
| 3,564,787 | 2/1971 | Sherman | 46/24 |
| 3,822,569 | 7/1974 | Lautrup et al. | 46/24 |

FOREIGN PATENT DOCUMENTS

| | | | |
|---|---|---|---|
| 2315453 | 1/1977 | France | 220/4 B |
| 1270715 | 4/1972 | United Kingdom | 220/4 E |

*Primary Examiner*—Allan N. Shoap
*Attorney, Agent, or Firm*—Heinrich W. Herzfeld

[57] ABSTRACT

A container having two chambers when assembled, comprises two container halves with each at least four walls rigidly connected with one another. Pairs of the outer chamber walls of each chamber are disposed parallel with one another, one pair forming right angles with the other pair. The walls of one pair are laterally extended beyond one of the walls of the other pair. The chambers of the container house articles of daily use, some disposed upright in the chamber of one container half, while articles in the chamber of the other container half are placed horizontally. Foot means are mounted on the outside of one of the laterally extended walls of one of the container halves, and are adapted for being placed or mounted on a base, whereby the laterally extended wall bearing the foot means is the bottom wall of the container and can be affixed to a table.

6 Claims, 4 Drawing Figures

CONTAINER FOR ARTICLES OF DAILY USE, HAVING TWO ENCLOSABLE CHAMBERS

EARLIER APPLICATION

This application is a continuation-in-part of my pending patent application Ser. No. 06/140,774, filed as PCT CH79/00011, Jan. 26, 1979, published as WO79/00558, Aug. 23, 1979, § 102(e) dated Sept. 26, 1979, now abandoned.

BACKGROUND OF THE INVENTION

This invention relates to a container for articles of daily use, having two enclosable chambers of parallelepiped block, or general rectangular shape. The container is constituted by a plurality of plate-shaped walls which are firmly and rigidly connected with one another.

Such containers are known and are used for keeping ornamental pieces, jewelry or sewing utensils. They have an oblong inset part placed in a casing open at the top and may have abutments which leave a space in the bottom part of the casing for the reception of larger articles. Smaller articles are placed in the inset part which is preferably subdivided into several compartments. The container can be closed by means of a single or double wing hinged lid. These known containers suffer from the drawback that the inset part must be taken out of the casing before the articles placed in the bottom part of the casing can be reached.

OBJECT AND SUMMARY OF THE INVENTION

It is an object of the invention to provide a container of the initially described type which, upon being opened by a single movement, will give directly free access to all chambers and compartments provided therein.

This object and others which will become apparent from the following description of the invention are achieved in accordance with the invention in a container of the initially described type which comprises two container halves each of which has at least four walls firmly and rigidly connected with one another and defining a first and a second chamber, respectively, therebetween, pairs of the outer walls of each chamber being disposed parallel with one another, one pair of such parallel walls forming right angles with the other pair of the outer walls of the same chamber and leaving opposite sides of that chamber open, the walls of one of these pairs of that same chamber being laterally extended, beyond a sidewall being one of the walls of the other pair of the same chamber, and serving as guide means for a similar pair of extended parallel walls of the other chamber during relative displacement of the container halves into and out of engagement with one another to close or open, respectively, openings in the said container halves constituted by sides thereof uncovered by the said walls.

Foot means are mounted on the outside of one of the laterally extended walls of one of the container halves, the foot means being adapted for being placed or mounted on a base, whereby the laterally extended wall bearing the foot means is the bottom wall of the container. The foot means can consist of four feet placed at the corners of the bottom wall. Or they can consist of a broadened base frame or plate affixed to the underside of the bottom wall in a conventional manner or made integral with the wall. For instance, if the cover half comprising the bottom wall is made from synthetic polymeric resin material by injection molding techniques, the base plate or feet can be produced integral therewith.

Screw or bolt means can be provided with the base plate or similar foot means whereby these means can be mounted stationary on a work table, desk or the like surface. This will guarantee that, when the box is opened by withdrawing the movable cover half, neither the vertically disposed contents of the cover part being removed, nor the horizontally disposed contents of the stationary cover half will drop out of their respective chambers or compartments.

Of course, for this same purpose the vertically disposed chambers or compartments of the movable cover half must be closed by an inwardly disposed bottom wall.

Preferably, the length by which the walls of the one pair defining a chamber extend beyond the respective wall of the other pair of walls of the same chamber is sufficient to cover an opening in the side of the chamber defined in the other container half.

Preferably, at least one of the container halves comprises a fifth wall closing one of the openings left between the two pairs of walls of the chamber in that same container half.

The lateral rims of all portions of the extended walls of one wall pair which protrudes beyond the respective wall of the said other wall pair defining the same chamber in one container half, which rims are destined for contact with corresponding rims of the other container half, can be bevelled inwardly; and the frontal end rim of each extended wall of one chamber and the rim of the corresponding wall of the other chamber with which the said frontal end rim is destined to engage upon complete closing engagement of the two container halves can also be bevelled inwardly, i.e. from the outer, higher edge toward the interior of the respective chamber.

On the other hand, the lateral rims of all portions of the extended walls which protrude beyond the respective wall of the said other wall pair defining the same chamber in one container half, as well as the corresponding lateral rims of the other container half can be devised as groove-and-tongue joints for sliding engagement with one another.

The portions of the extended walls of one wall pair which protrude beyond the respective sidewall of the said other wall pair in the same container half can have in their internal faces turned toward one another each a guide groove extending parallel to and spacedly from the lateral rims of such portion and ending short of a frontal end rim of that portion, and the other container half can comprise tongue means for engagement with the said guide groove and affixed to the respective sidewall of that other container half.

Subdividing wall means can be affixed in at least one of the two chambers subdividing such chamber into at least two compartments. Either, one of the extended walls, or a first wall of that pair of walls beyond the second wall of which the extended walls of the other pair in the same container half protrude, is destined as a base wall upon which the container rests, and foot means can be provided on the said base wall.

The fifth wall in one of the container halves can be provided with at least one opening, and one of the extended walls of the same container half or one of the frontal walls of the container should then serve as base wall upon which the container rests. When the chamber having the aforesaid fifth wall as one of its sidewall is subdivided into several horizontal compartments, then that fifth wall can have a plurality of openings each of which permits access to one of these compartments.

BRIEF DESCRIPTION OF THE DRAWINGS

Further details of the container according to the invention will be apparent from the following description of preferred embodiment thereof in connection with the accompanying drawing in which.

DETAILED DESCRIPTION OF THE EMBODIMENTS SHOWN IN THE DRAWING

Figure 1:
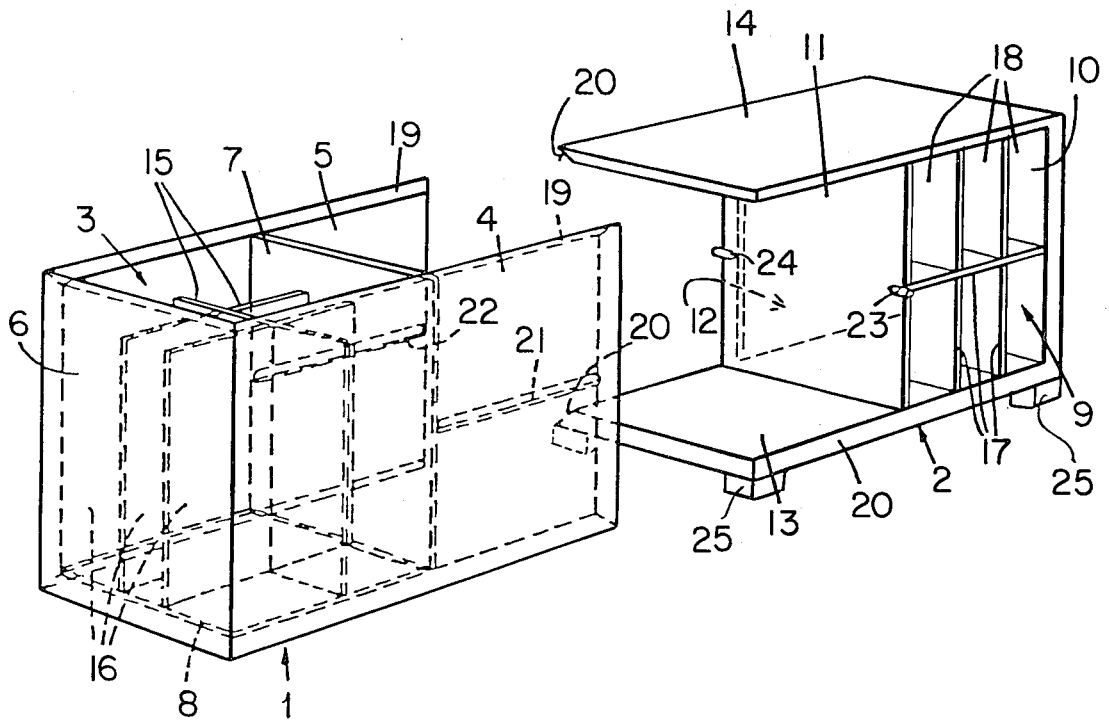
FIG. 1 shows in schematic perspective representation a preferred embodiment of the container according to the invention, the two container halves of which are shown completely disengaged from one another.
Figure 2:
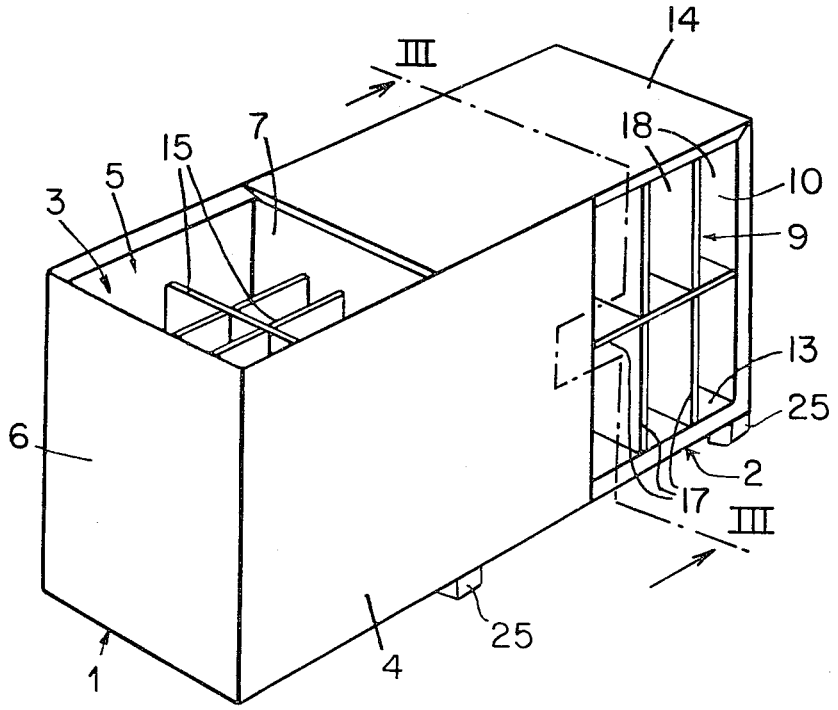
FIG. 2 shows a similar view of the same embodiment, but with the two container halves at the point of beginning engagement with one another, all compartments in the two chambers of the container being accessible.
Figure 3:
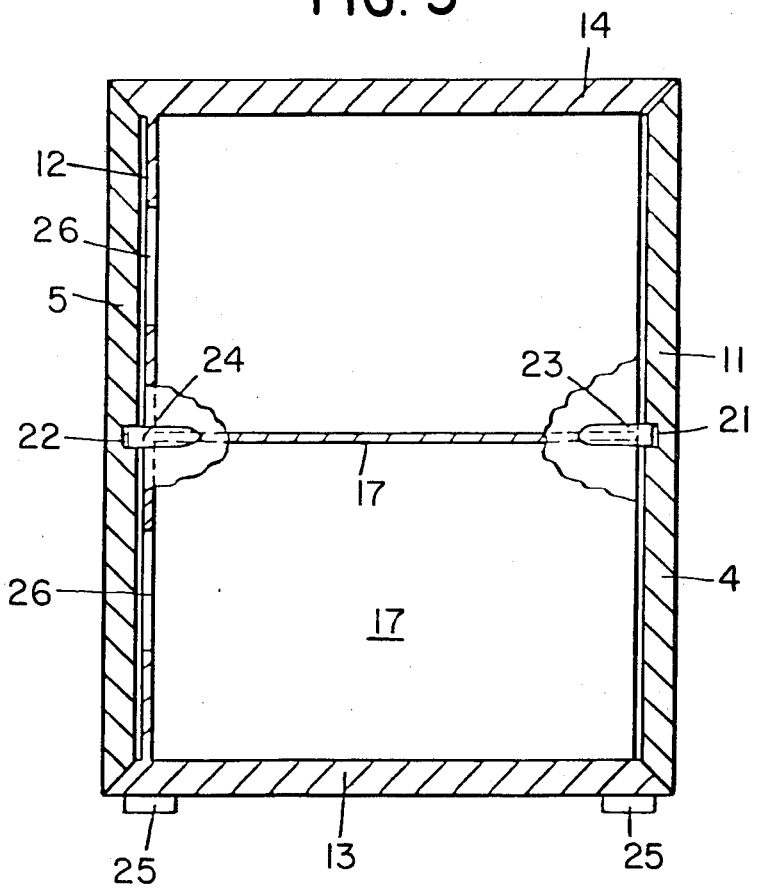
FIG. 3 is a cross-sectional view of the embodiment shown in FIGS. 1 and 2 taken in a plane indicated by III—III in FIG. 2.

The embodiment of a container according to the invention shown in FIGS. 1 to 3 of the drawing consists of two container halves 1 and 2 which are very similar to one another. The container half 1 contains a chamber 3 which is defined by two longitudinal sidewalls 4 and 5, a short vertical front end wall 6 and a vertical intermediate wall 7 and, preferably, by a slightly inwardly disposed bottom wall 8. The container half 2 contains a horizontal chamber 9 which is delimited by an outer vertical rear end wall 10, an inner rectangular vertical wall 11, parallel to rear end wall 10, an extended rectangular bottom wall 13 which serves preferably as the base wall on which the container rests, and an extended rectangular top wall 14, as well as, optionally a rear side wall 12 which is visible in FIG. 3.

When bottom wall 13 is the base wall, then an inwardly disposed bottom wall 8 must be present in the second container half 1 while rear sidewall 12 in container half 2 remains optional.

The chamber 3 of the first container half 1 can be divided by means of subdividing walls 15 into several vertically extending compartments 16 open at the top which may be used advantageously for keeping therein small bottles and the like articles which are best stored in upright position. The first chamber 9 in the first container half 2 can be divided by means of subdividing walls 17 into several horizontal compartments 18 for receiving therein articles which are preferably stored in horizontal position.

The rims along the lateral edges of the longitudinal sidewalls 4 and 5 of the upright chamber 3 and of the extended bottom wall 13 and top wall 14 are preferably bevelled inwardly, i.e., from their higher outer edges toward the interior of the respective container half, whereby guide faces 19 are formed on the walls 4 and 5, and guide faces 20 are formed on the walls 13 and 14, respectively. By means of these guide faces there is achieved an exactly parallel guidance during movement of the container halves 1 and 2 relative to each other.

On the bevelled guide faces 19 and 20, there is no danger of dust and dirt particles accumulating, because those guide faces which are in frictional engagement with one another during opening and closing of the container are self-cleaning.

Preferably the front rims at the free ends of extended walls 4, 5, 13 and 14 as well as those rim zones of front walls 6 and 10 which abut against these free end rims when the container is closed, are also bevelled inwardly.

The closed container has the aspect of a parallelepiped block, the chambers 3 and 9 in the container halves 1 and 2 are of the same shape, and preferably of cubic design.

In order to avoid that the two container halves 1 and 2 can be unintentionally completely separated at each opening movement, the inner side of the extended portions of the longitudinal sidewalls 4 and 5 protruding beyond the intermediate wall 7 of chamber 3 can each bear a guide groove 21, 22 which extends parallel to their lateral rims 19 and ends short of the bevelled guide face 20 of the frontal rim at the free end of each of these extended wall portions.

These grooves 21 and 22 are, respectively, engaged by outwardly projecting pins 23 and 24 which are mounted at the appropriate level or levels on the lateral rims of the inner vertical wall 11 of the first chamber 9 in the container half 2, and protrude into grooves 21 and 22, respectively, when the two container halves 1 and 2 are assembled.

When assembling these halves 1 and 2 for the first time, the longitudinal sidewalls 4 and 5 are slightly spread apart by the pins 23 and 24 slidingly deforming these walls as the pins move up their beveled end faces, whereupon the pins enter grooves 21 and 22. Thereupon, the container halves 1 and 2 can no longer be separated easily from one another because their relative movement is limited by the pins 23 and 24 abutting against the outer ends of guide grooves 21 and 22.

The bottom wall 13 must be used as the base of the container and can be provided with foot pieces 25 (shown in FIG. 3) at or near its corners.

In order to facilitate the removal of articles stored in the horizontal compartments 18 of chamber 9, it is advantageous to provide windows 26 in the rear sidewall 12 when the latter is present. Preferably, each of the compartments has a window of its own, whereby it is possible to push an article out of a compartment 18 through the opposite open end of the latter.

As indicated in FIG. 2, FIG. 3 is viewed in two different sectional planes, a central one in which pins 21 and 22 are visible and a second one intersecting two superimposed compartments 18.

Figure 4:
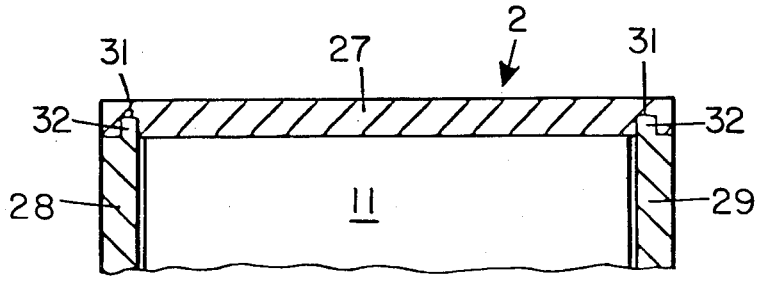
FIG. 4 is a partial cross-sectional view of a somewhat different embodiment of the engagement of the two container halves, taken in a plane similar to III—III in FIG. 2 but with the container halves fully enclosing the respective interiors.

FIG. 4 shows an upper part of a somewhat different embodiment of the container according to the invention, taken in the last-mentioned plane extending through compartments 18. The difference is in the type of guiding means adopted in this embodiment between the rims of the extended walls 4, 5, 13 and 14 of the two container halves 1 and 2.

Only the extended top wall 27 of the horizontally disposed chamber 9, as well as the upper parts of the longitudinal sidewalls 28 and 29 and of a subdividing wall 18 of the horizontally disposed chamber 9 of container half 2 are shown in FIG. 4.

Along the lateral longitudinal rims of the top wall 27 and correspondingly in the bottom wall (not shown) of container half 2 there are provided longitudinal grooves 31 into which protrude correspondingly keys or tongues 32 protruding upwardly from the longitudinal top rim faces, and the opposite bottom rim faces (not shown) of the longitudinal sidewalls 28 and 29. This type of groove-and-tongue engagement also offers an accurate guidance of the container halves during displacement relative to one another for the purpose of opening or closing the container.

Instead of having a specially devised key or tongue 32 designed on the last-mentioned longitudinal rims of sidewalls 28 and 29, the grooves 31 can also be devised of wide enough transverse diameter to receive the entire top or bottom rims of sidewalls 28 and 29 therein.

The above-described embodiments of the container according to the invention serve for keeping small articles of daily use in an orderly arrangement, presenting a chamber, subdividable into compartments, for housing articles better stored in upright position and another chamber, subdivided into compartments, for housing articles which are preferably horizontally disposed.

Drawers or drawer-like inserts can be provided in horizontal compartments 18 of chamber 9 and can serve for keeping small ornamental articles, rings, jewels and the like.

I claim:

1. A container for small articles of daily use, comprising (I) a first container half comprising:

(a) a rectangular bottom wall having four edges, an upper face and an underside, (b) foot means on the underside of said bottom wall and adapted for being placed on a horizontal base surface, (c) a rectangular vertical rear end wall having a lower edge, an upper edge and two side edges, and having said lower edge rigidly connected to a first one of the edges of said bottom wall, (d) an inner rectangular vertical wall having a lower edge, an upper edge and two side edges and being rigidly mounted with its lower edge on said upper face of said bottom wall in parallel with said rear end wall and in a position intermediate said first one of the edges of the bottom wall and the edge thereof opposite said first one edge, (e) a rectangular top wall of equal size with said bottom wall and having an upper face, an underside, and four edges, said top wall being rigidly attached with a first one of its edges to said upper edge of said rear end wall and resting with its underside on the upper edge of said inner vertical wall, so as to extend parallel with said bottom wall, the edges of said bottom wall and of said top wall being of substantially equal length;

(f) said top wall, bottom wall, rear end wall and inner vertical wall enclosing on four sides a horizontally disposed first chamber of parallelepiped block shape, and (g) subdividing wall means mounted inside said first chamber for dividing said first chamber into a plurality of horizontal compartments each of which has at least one open end and extends therefrom parallel with said rear end wall;

(II) a second container half comprising (a) first and second vertically disposed rectangular longitudinal sidewalls, each sidewall having two upright edges of the same height as said rear end wall, and two longitudinal edges the length of each of which is equal with a respective parallel edge of said bottom and top walls, said longitudinal sidewalls of said second container half extending normal with regard to said rear end wall of said first container half, (b) a vertical front end wall of equal size and configuration with said rear end wall of said first container half, having a lower edge, an upper edge and two side edges, one of said side edges being rigidly joined at right angle with a first upright edge of said first longitudinal sidewall, and the other side edge of said front end wall being ridgidly joined at right angle with a first upright edge of said second longitudinal sidewall, (c) a rectangular vertical intermediate wall, of equal size and configuration as said inner vertical wall of said first container half, and disposed parallel with said front end wall, said intermediate wall having a top edge, a bottom edge, a first side edge and a second side edge, said first side edge thereof being rigidly mounted on the inner surface of said first longitudinal sidewall, and said second side edge thereof being rigidly mounted on the inner surface of said second longitudinal sidewall, (d) said intermediate wall, front end wall and longitudinal sidewalls enclosing on four sides a vertically disposed second chamber of parallelepiped block shape, (e) subdividing wall means mounted inside said second chamber for dividing said second chamber into a plurality of vertical compartments having open top ends, (f) bottom wall means at the lower ends of said vertical compartments for closing the latter, said bottom wall means and lower ends of said vertical compartments being at a level, above the lower longitudinal edges of said longitudinal sidewalls, which level is above the level of the upper face of said bottom wall of said first container half when the underside of the said bottom wall is flush with said lower edges of said longitudinal sidewalls, (g) said longitudinal sidewalls protruding with free sidewall ends beyond said intermediate wall which free sidewall ends are of a size sufficient to cover entirely the open ends of all of said horizontal compartments in said first chamber, and (h) said top wall and bottom wall of said first container half protruding with free top and bottom wall ends, respectively, beyond said inner vertical wall, which free top and bottom wall ends are of sufficient size to cover entirely, respectively, the open top ends and the lower closed ends of said vertical compartments in said second chamber, when said two container halves are in closing engagement with each other; and (III) guide means associated with longitudinal edges of said longitudinal sidewalls and of said top wall and bottom wall, said guide means of said longitudinal sidewalls being adapted for engaging the guide means of said top wall and bottom wall, respectively, for sliding displacement of said first and second container halves relative to one another.

2. The container of claim 1, wherein said guide means comprise inwardly bevelled edges along said longitudinal edges of said longitudinal sidewalls and of said top wall and bottom wall.

3. The container of claim 1, wherein said guide means comprise groove- and tongue joints for sliding engagement with one another.

4. The container of claim 3, wherein the free wall ends of one of the two pairs, one of which two pairs is constituted by said bottom wall and said top wall of said first container half and the other of which two pairs is constituted by said first and second longitudinal sidewalls of said second container half, bear each a guide groove extending parallel to and spacedly from the edges thereof normal with regard to the respective end walls of the respective container halves; and free wall ends of the other pair, in the other container half, comprise each tongue means adapted for engagement with the adjacent one of said guide grooves.

5. The container of claim 1, wherein said first container half comprises an internal rectangular sidewall rigidly connected with said top wall, said bottom wall, said first end wall and said second vertical wall of said first container half, to close one of the open ends of each of said horizontal compartments on the same side, while leaving the opposite ends of said horizontal compartments open.

6. The container of claim 5, wherein at least one window is provided in said internal rectangular side wall.

* * * * *